US012781621B2

(12) United States Patent
Yang et al.

(10) Patent No.: US 12,781,621 B2
(45) Date of Patent: Nov. 3, 2026

(54) USING NON-COLLINEAR AND NON-ORTHOGONAL SENSORS TO MEASURE DOWNHOLE TOOL DYNAMICS

(71) Applicant: Halliburton Energy Services, Inc., Houston, TX (US)

(72) Inventors: Jie Yang, Houston, TX (US); Boguslaw Wiecek, Houston, TX (US); Matthew C. Griffing, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 402 days.

(21) Appl. No.: 18/313,850

(22) Filed: May 8, 2023

(65) Prior Publication Data

US 2024/0376819 A1 Nov. 14, 2024

(51) Int. Cl.
*E21B 47/12* (2012.01)
*E21B 47/09* (2012.01)

(52) U.S. Cl.
CPC ..... *E21B 47/138* (2020.05); *E21B 47/09* (2013.01)

(58) Field of Classification Search
CPC ..... E21B 47/138; E21B 47/09; E21B 47/024
See application file for complete search history.

(56) References Cited

U.S. PATENT DOCUMENTS

2005/0126022 A1 6/2005 Hansberry et al.
2012/0259579 A1* 10/2012 Blake ..... G01C 21/183 702/151
2017/0122099 A1* 5/2017 Yao ..... E21B 49/003
2019/0271224 A1* 9/2019 Utsuzawa ..... E21B 47/00

FOREIGN PATENT DOCUMENTS

WO 2014093415 6/2014
WO WO 2018152636 * 8/2018 ..... E21B 47/24

OTHER PUBLICATIONS

"PCT Application No. PCT/US2023/066781, International Search Report and Written Opinion", Feb. 7, 2024, 11 pages.

* cited by examiner

*Primary Examiner* — Alexander Satanovsky
(74) *Attorney, Agent, or Firm* — DeLizio, Peacock, Lewin and Guerra, LLP

(57) ABSTRACT

Embodiments of a method, system, and apparatus for using non-collinear and non-orthogonal sensors to measure downhole tool dynamics are disclosed. In one embodiment, a method includes receiving data from a first sensor mounted on a chassis of a downhole tool; receiving data from a second sensor, wherein the second sensor is mounted on the chassis and is positioned non-collinear relative to the first sensor; mathematically transforming the received data from the first and second sensor such that the transformed data represents the first sensor and the second sensor as if positioned orthogonal relative to each other; and determining motion data in a wellbore from the transformed data.

19 Claims, 6 Drawing Sheets

USING NON-COLLINEAR AND NON-ORTHOGONAL SENSORS TO MEASURE DOWNHOLE TOOL DYNAMICS

BACKGROUND

The disclosure generally relates to the field of well logging of subsurface formations, and in particular, using non-collinear sensors and accelerometers to measure downhole tool dynamics.

In the field of logging (e.g., wireline logging, logging while drilling (LWD) and measurement while drilling (MWD)), LWD, MWD, and nuclear magnetic resonance (NMR) tools have been used to perform formation evaluation of subsurface formations. Some downhole NMR tools include a magnet assembly that produces a static magnetic field and a coil assembly that generates radio frequency (RF) control signals and detects magnetic resonance phenomena in the subsurface material. Properties of the subsurface formation can be identified from the detected phenomena.

However, downhole sensors, may have a relatively small radial extent of the sensitivity area, thereby making well logging data sensitive to lateral (radial) motion of the tool on which the sensors are mounted. In applications of NMR logging while drilling (LWD), the lateral motion, and vibration along with rotation may cause severe distortion of the data. While rotational sensitivity may be reduced or eliminated by designing an axially-symmetrical sensor, the longitudinal and lateral displacement due to tool motion/vibration remains a challenge, especially in LWD and MWD applications, and can impact sensor data.

BRIEF DESCRIPTION OF THE DRAWINGS

Embodiments of the disclosure may be better understood by referencing the accompanying drawings.

DETAILED DESCRIPTION

Figure 1:
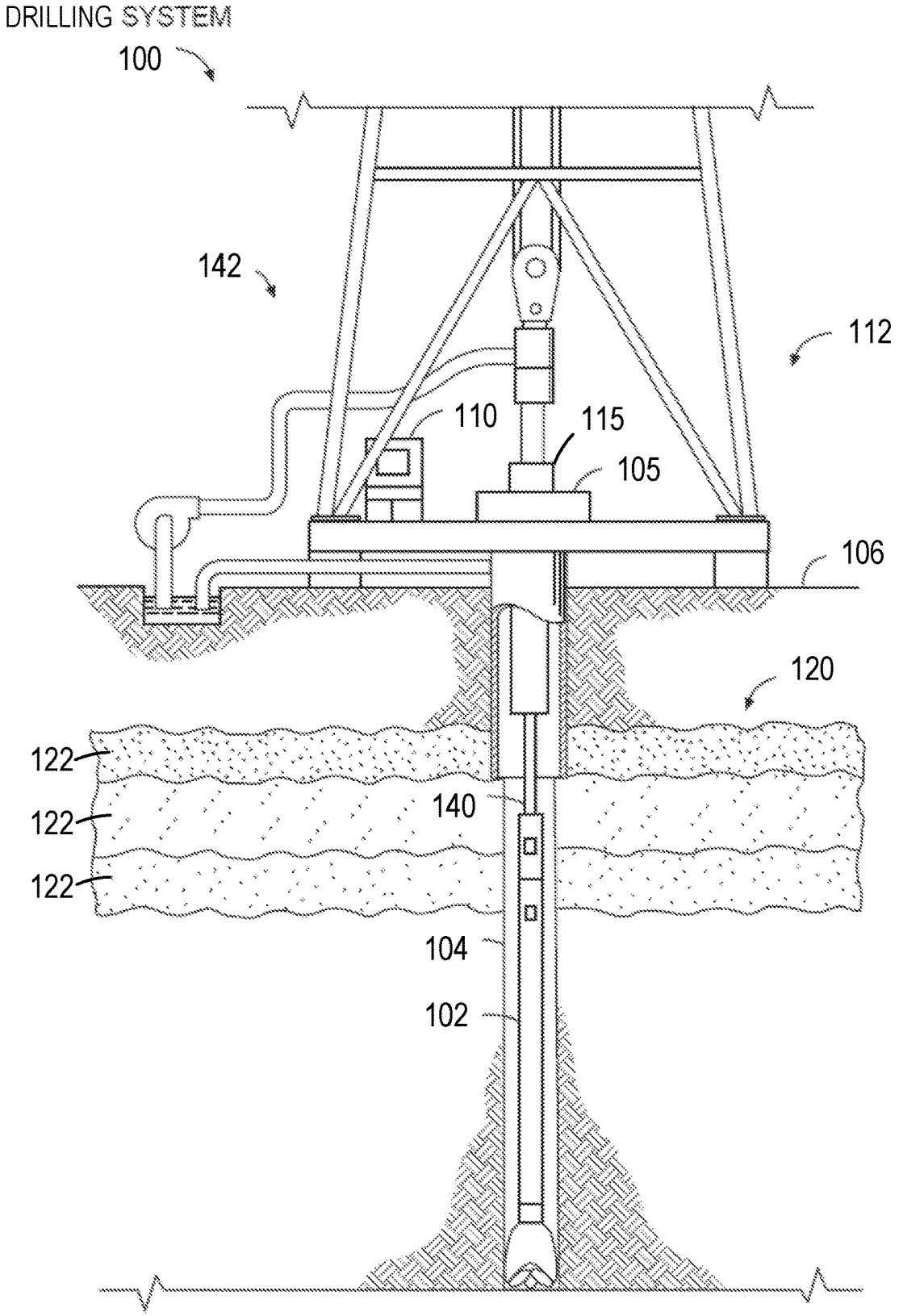
FIG. 1 is a schematic view of a drilling system that includes logging tools, according to some embodiments.

The description that follows includes example systems, methods, techniques, and program flows that embody aspects of the disclosure. However, it is understood that this disclosure may be practiced without these specific details. For instance, this disclosure refers to collecting data in a wellbore while using LWD, MWD, and NMR tools in illustrative examples. MWD and LWD are two types of downhole measurement tools used in wellbore drilling and completion operations to collect real-time data on the formation properties, wellbore trajectory, and drilling conditions.

MWD tools measure various drilling parameters such as the drilling direction, inclination, and azimuth, as well as the rate of penetration (ROP), weight on bit (WOB), torque, and other drilling parameters. This data is transmitted to the surface in real-time via mud pulses or electromagnetic waves, allowing the drilling operator to monitor and adjust the drilling process as needed. LWD tools, on the other hand, are designed to measure formation properties such as resistivity, porosity, density, and gamma ray levels, as well as other properties like borehole size and shape. These tools use various types of sensors such as gamma ray detectors, sonic and ultrasonic sensors, and resistivity sensors to collect data as they drill through the rock formations. The data collected by both MWD and LWD tools is critical for accurate wellbore placement, formation evaluation, and optimizing drilling performance. The data can be used to make decisions regarding the drilling process, including adjusting the drilling trajectory, selecting the right drilling fluids and bit types, and optimizing the well completion process. In summary, MWD tools measure drilling parameters and wellbore trajectory, while LWD tools measure formation properties to provide a better understanding of the geology surrounding the wellbore. In other instances, well-known instruction instances, protocols, structures and techniques have not been shown in detail in order not to obfuscate the description.

For tools that allow for data to be collected while the tool is moving, lateral motion can have a significant impact on sensor data. The capability to be able to separate translational motion from rotation is important in logging tools, imaging tools, acoustic sensors, and NMR tools. Typically, sensors are positioned in an orthogonal and/or collinear arrangement (90 degrees or 180 degrees apart). This arrangement can be challenging for mounting sensors when certain tools and chassis are used, such as, e.g., LWD tools when delta chassis is used. The information and embodiments disclosed herein can relax the orientation restriction to allow for non-orthogonal and non-collinear placement of sensors.

Embodiments disclosed herein enable sensors, such as, e.g., vibration sensors, to be mounted in non-orthogonal and non-collinear arrangements while still able to use traditional data collection results that assume the sensors are mounted orthogonal relative to each other and aligned with the radial axis of the downhole tool. Embodiments of the disclosure provide several improvements over previous systems, including, but not limited to relaxing space and placement requirement for board mounting of sensors on LWD and MWD tools and offering more flexibility for engineering for placement of sensors on downhole tools. Once raw data is collected from a plurality of sensors positioned on or along a downhole tool, the raw sensor data is then transformed into either 90 degree or 180 degrees mathematically as if the sensors were mounted in an orthogonal or collinear configuration before further traditional processing and analysis of the sensor data. As a result, engineering and field operations may have more flexibility in placement of sensors on downhole tools. The physical design of sensor placement and mechanical mounting process of the sensor assemblies may be simplified without compromising data results. For example, in systems having smaller tool sizes, (e.g., tools having a 4¾' in. diameter) mounting of the sensor assemblies may be simplified, and for larger tool sizes, the sensor assemblies may be mounted without having to be placed orthogonally. In addition to correction of the data to reflect orthogonal and/or collinear sensors, the translation and rotational data may be used to process and correct data collected from additional sensors which may be positioned on downhole tools, such as NMR, imaging, or acoustic sensors. In some embodiments, axial motion along the Z axis may also be considered and factored into the data transformation to reflect three-dimensional motion.

Example embodiments may include one embodiment of a method comprising receiving raw data from a first sensor mounted on a chassis of a downhole tool and receiving raw data from a second sensor, wherein the second sensor is mounted on the downhole tool non-orthogonal and non-collinear relative to the first sensor. The method continues with mathematically transforming the received raw data from the first and second sensors such that the transformed data represents the first sensor and the second sensor as if positioned orthogonal relative to each other. The method further includes determining motion data in the wellbore from the transformed data. Mathematically transforming the received raw data may include determining translational motion of the downhole tool and determining rotational motion of the downhole tool. In some embodiments, the method includes determining whether at least one of the sensors is not aligned with the radial axis of the tool chassis and mathematically transforming the data using equations that consider the angle of misalignment from the radial axis.

Other example embodiments may include a system comprising a downhole tool for use in a wellbore. At least a first sensor and a second sensor may be mounted on a chassis of the downhole tool, wherein the first sensor and second sensor are non-orthogonal and non-collinear relative to each other. The system may include a processor configured to receive data from the first and second sensor; mathematically transform the received data from the first sensor data and the second sensor such that the transformed data represents the first sensor and the second sensor as if positioned orthogonal relative to each other; and determine motion data in the wellbore from the transformed first and second sensor data.

In another example embodiment, an apparatus may comprise a processor; and a non-transitory computer-readable medium having instructions stored thereon that are executable by the processor. The instructions may cause the processor to receive data from at least a first sensor and a second sensor mounted on a chassis of a downhole tool, wherein the first sensor and second sensor are non-orthogonal and non-collinear relative to each other, wherein the data is collected as the downhole tool is moving within a wellbore. The processor may mathematically transform the received data from the first sensor and the second sensor such that the transformed data represents the first sensor and the second sensor as if positioned orthogonal relative to each other; and determine motion data in the wellbore from the transformed data.

While a main wellbore may in some instances be formed in a substantially vertical orientation in a subsurface formation relative to a surface of the well, and while a lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers to a direction that is towards the surface of the well, while the term "downhole" refers to a direction that is away from the surface of the well.

Example Systems

FIG. 1 is a schematic view of an example drilling system 100 that includes logging tools, according to some embodiments. The drilling system 100 includes a logging tool 102 disposed on a drill string 140 within a wellbore 104 formed in a subsurface formation 120 comprising subsurface zones 122 beneath a ground surface 106. The drilling system 100 can include additional or different features that are not shown in FIG. 1. For example, the drilling system 100 may include additional drilling system components.

Drilling is commonly carried out using a string of drill pipes connected together to form the drill string 140 that is lowered into the wellbore 104. In some embodiments, the drill string 140 can be lowered through a kelly bushing 115 and a rotary table 105 into the wellbore 104. In some cases, a drilling rig 142 at the surface 106 supports the drill string 140, as the drill string 140 is operated to drill the wellbore penetrating the subsurface formation 120. The drill string 140 may include, for example, a Kelly, drill pipe, a bottom hole assembly, and other components. The bottom hole assembly on the drill string may include drill collars, drill bits, the logging tool 102, and other components.

The subsurface formation 120 can include all or part of one or more subsurface zones. The example subsurface formation 120 shown in FIG. 1 includes multiple subsurface zones 122 and the wellbore 104 penetrated through the subsurface zones 122. The subsurface zones 122 can include sedimentary layers, rock layers, sand layers, or combinations of these and other types of subsurface layers. One or more of the subsurface layers can contain fluids, such as brine, oil, gas, etc. Although the example wellbore 104 shown in FIG. 1 is a vertical wellbore, the logging tool 102 can be implemented in other wellbore orientations. For example, the logging tool 102 may be adapted for horizontal wellbores, slanted wellbores, curved wellbores, vertical wellbores, or combinations of these.

In some implementations, the logging tool 102 may perform MWD or LWD logging. As shown, for example, in FIG. 1, the logging tool 102 can be deployed in the wellbore 104 on jointed drill pipe, hard wired drill pipe, or other deployment hardware. In some example implementations, the logging tool 102 collects data during drilling operations as it moves downward through the region of interest. In some example implementations, the logging tool 102 collects data while the drill string 140 is moving within the wellbore 104.

In some implementations, sensor assemblies of the logging tool 102 collects data at discrete logging points in the wellbore 104. For example, the logging tool 102 can move upward or downward incrementally to each logging point at a series of depths in the wellbore 104. At each logging point, instruments in the logging tool 102 can perform measurements on the subsurface formation 120. The measurement data can be communicated to a computer 110 or processor thereof for storage, processing, and analysis. Such data may be gathered and analyzed during or after drilling operations or during other types of activities.

The measurement data can be used for formation evaluation of the subsurface formation 120. For example, the computer 110 can receive and analyze the NMR measurement data from the logging tool 102 to detect properties of the various subsurface layers 122. For example, the computer 110 can identify the porosity, fluid partition, or other properties of the subsurface layers 122 based on the measurements acquired by the logging tool 102 in the wellbore 104.

In some instances, all or part of the computer 110 can be implemented as a component of, or can be integrated with one or more components of the logging tool 102. In some cases, the computer 110 can be implemented as one or more computing structures separate from the logging tool 102.

In some implementations, the computer 110 is embedded in the logging tool 102, and the computer 110 and the logging tool 102 can operate concurrently while disposed in the wellbore 104. For example, although the computer 110 is shown above the surface 106 in the example shown in FIG. 1, all or part of the computer 110 may reside below the surface 106, for example, at or near the location of the logging tool 102.

The drilling system 100 can include communication or telemetry equipment that allows communication among the computer 110, the logging tool 102, and other components of the drill string 140. For example, the components of the drill string 140 can each include one or more transceivers or similar apparatus for wired or wireless data communication among the various components. For example, the logging tool 102 and drill string 140 can include systems and apparatus for optical telemetry, wireline telemetry, wired pipe telemetry, mud pulse telemetry, acoustic telemetry, electromagnetic telemetry, or a combination of these and other types of telemetry. In some cases, the logging tool 102 receives commands, status signals, or other types of information from the computer 110 or another source. In some cases, the computer 110 receives logging data, status signals, or other types of information from the logging tool 102 or another source.

Logging operations can be performed in connection with various types of downhole operations at various stages in the lifetime of a well system. Structural attributes and components of a surface equipment 112 and the logging tool 102 can be adapted for various types of logging operations. For example, logging may be performed during drilling operations, during wireline logging operations, or in other contexts. As such, the surface equipment 112 and the logging tool 102 may include, or may operate in connection with drilling equipment, wireline logging equipment, or other equipment for other types of operations.

Figure 2:
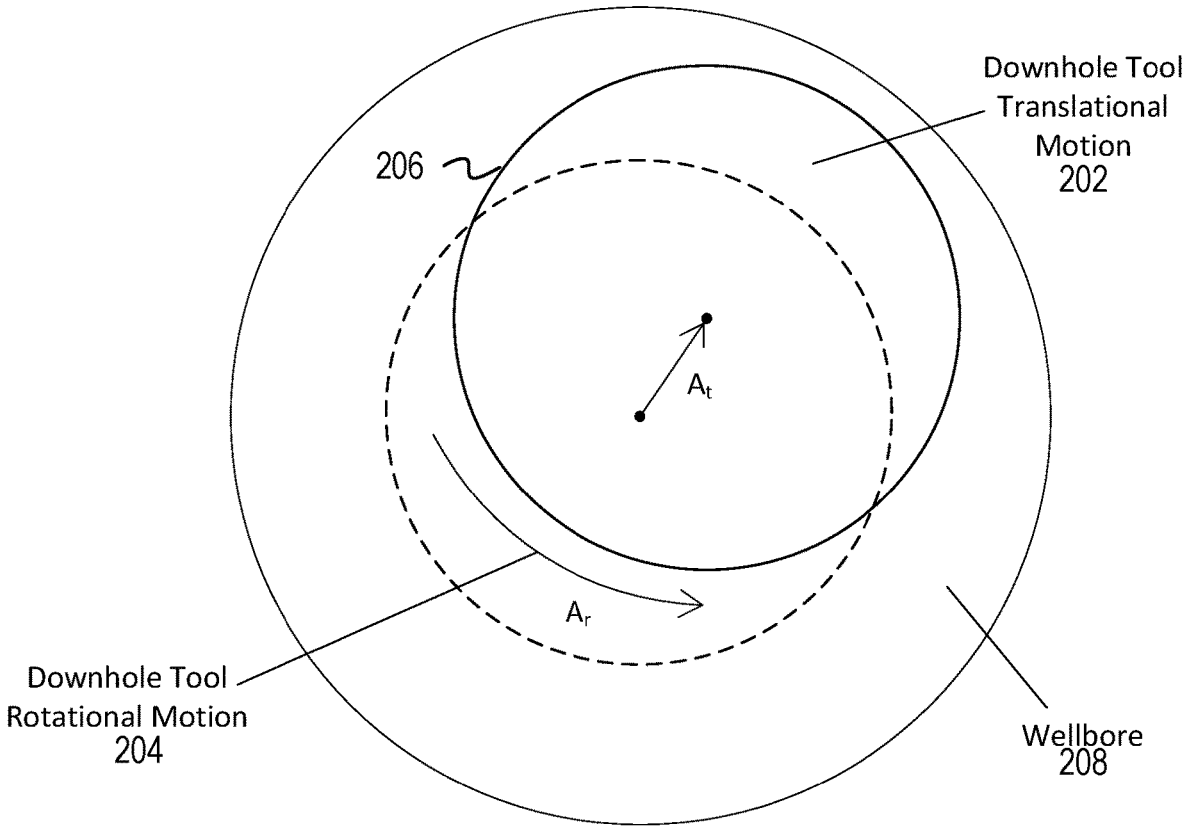
FIG. 2 is an illustration of an example of translational and rotational acceleration experienced in downhole tools, according to some embodiments.

FIG. 2 is an illustration of example translational motion 202 and rotational motion 204 which may be experienced by a downhole tool 206 positioned within a wellbore 208. This translational motion 202 and rotational motion 204 is likewise experienced by sensors which may be mounted on the downhole tool. At represents translation acceleration motion and $A_r$ represents rotational acceleration motion.

Figure 3A:
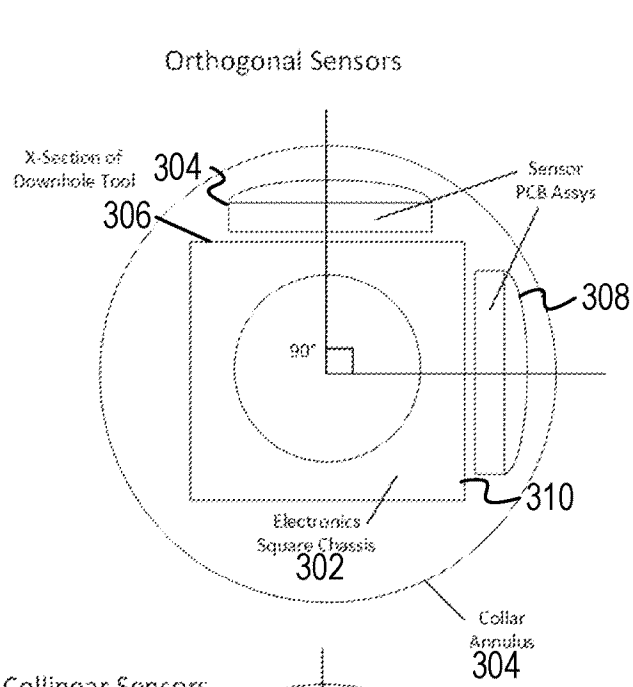
FIG. 3A is an illustration of positional relationships of orthogonal sensors on a downhole tool, according to some embodiments.
Figure 3C:
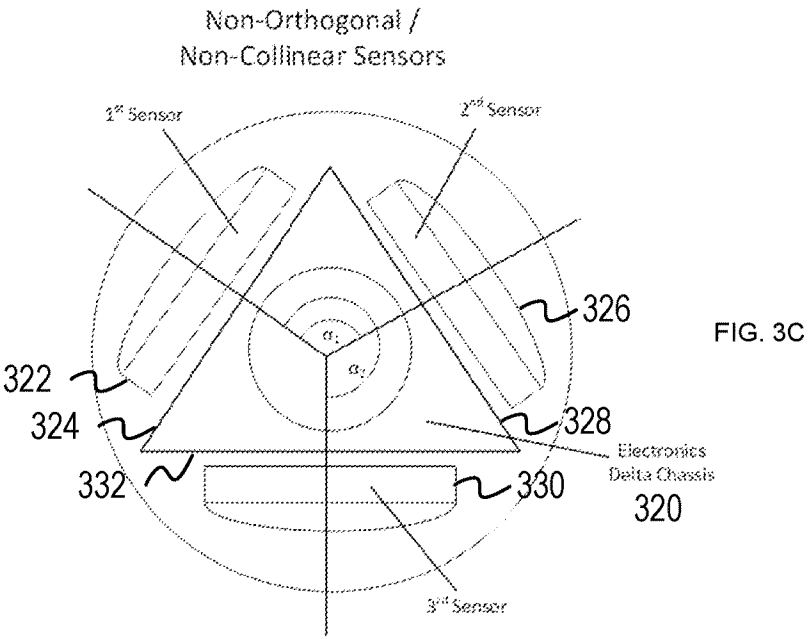
FIG. 3C is an illustration of one example of positional relationships of non-collinear, non-orthogonal sensors on a downhole tool, according to some embodiments.
Figure 3B:
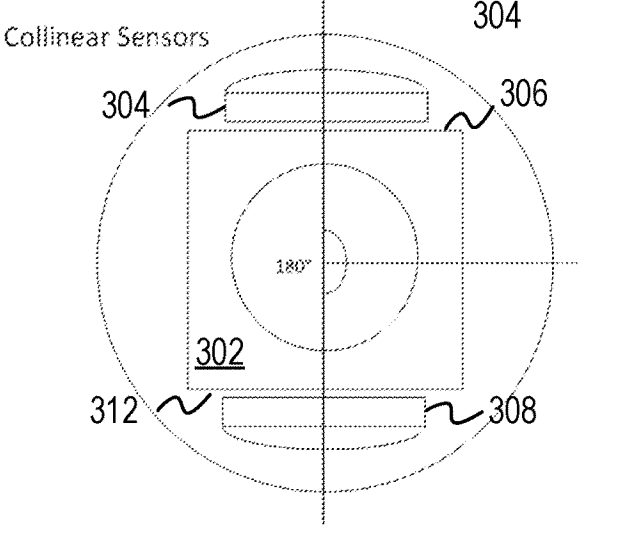
FIG. 3B is an illustration of positional relationships of collinear sensors on a downhole tool, according to some embodiments.
Figure 3D:
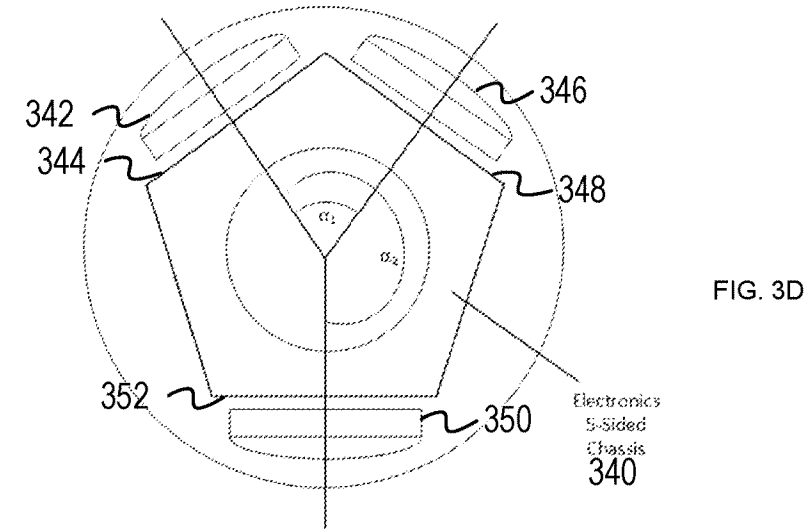
FIG. 3D is an illustration of another example of positional relationships of non-collinear, non-orthogonal sensors on a downhole tool, according to some embodiments.

FIG. 3A through 3D are views of different tool chassis and sensor mounting arrangements. FIGS. 3A and 3B illustrate sensors, which may generally be sensor and printed circuit board (PCB) assemblies, placed in a traditional orthogonal and collinear configuration. In FIG. 3A, there is shown a tool chassis 302 having a first sensor 304 placed on a first surface 306 and a second sensor 308 placed on a second surface 310, positioned about 90 degrees, or orthogonal to the first sensor 304. FIG. 3B illustrates the second sensor 308 placed on a third surface 312, positioned 180 degrees, or collinear with the first sensor 304. While a square electronics tool chassis such as shown in FIGS. 3A and 3B provides a collinear or orthogonal arrangement, some tool chassis may not be square, may have size limitations, or various geometries and as such, may present a challenge for mounting the sensors in collinear or orthogonal arrangements. For example, the 3-sided (delta) chassis of FIG. 3C and 5-sided chassis such as shown in FIG. 3D will create non-collinear arrangements between the sensors.

FIGS. 3C and 3D illustrate examples of positional relationships for non-collinear and non-orthogonal sensors (or sensor/PCB assemblies), aligned with the radial axis of a downhole LWD tool electronics chassis. FIG. 3C illustrates a 3-sided (delta) tool chassis 320 having a first sensor 322 mounted on a first surface 324 of the chassis 320, a second sensor 326 is mounted on a second surface 328 of the chassis 320, and a third sensor 330 is mounted on a third surface 332 of the chassis. None of the first sensor 322, second sensor 326, or third sensor 330 are positioned collinear or orthogonal relative to each other.

FIG. 3D illustrates a 5-sided tool chassis 340. The 5-sided chassis 340 has a first sensor 342 mounted on a first surface 344, a second sensor 346 mounted on a second surface 348, and a third sensor 350 mounted on a third surface 352. None of the first sensor 342, second sensor 346, or third sensor 350 are positioned orthogonal or collinear relative to each other. Although only three sensors are illustrated, in other examples, one or more additional sensors may be mounted on the remaining surfaces of the chassis 340.

The data collected from the non-orthogonal and non-collinear sensors shown in FIGS. 3C and 3D may be mathematically processed and transformed to decompose the motion and provide transformed data results as if the sensors were mounted in an orthogonal or collinear configuration. As a result, engineering and field operations may have more flexibility in design and placement of sensors on downhole tools.

Any motion can be decomposed into translational and rotational motion, and in some embodiments, axial motion. The sensors mounted in close proximity with each other will experience similar motion, so to interpret and transform raw data collected from a plurality of sensors, it is needed to separate translational motion from rotational motion. Raw data collected from the sensors aligned with the radial axis of the downhole too, but not positioned orthogonal or collinear with respect to other sensors, such as those in FIGS. 3C and 3D, may be processed according to the following equations to solve for translational acceleration ($A_t$) and rotational acceleration ($A_r$) in order to interpret the raw sensor data as if the sensors are positioned orthogonal and/or collinear.

Suppose there are n number of sensors with n−1 angles: $\alpha_1$ between $1^{st}$ and $2^{nd}$ sensors, $\alpha_2$ between $1^{st}$ and $3^{rd}$, . . . $\alpha_{n-1}$ between $1^{st}$ and $n^{th}$. Each sensor has X (parallel to the printed circuit board (PCB) and Y (perpendicular to the PCB) in the rotation frame with the 1st sensor. The X and Y components of each sensor is represented according to the following Equations (1), expressing each sensor in a complex number based on how each sensor assembly (sensor and PCB) are mounted on the tool:

$$1^{st}\text{ sensor }(X_1, Y_1) = R_1 e^{j\theta_1},\quad 2^{nd}\text{ sensor }(X_2, Y_2) = R_2 e^{j\theta_2},\quad \ldots\quad n^{th}\text{ sensor }(X_n, Y_n) = R_n e^{j\theta_n} \tag{Eqs. (1)}$$

wherein $\theta_n$ is the angle measured on $n^{th}$ sensor in its own coordinate system, and wherein $$R_n = \sqrt{X_n^2 + Y_n^2},\ \theta_n = \tan^{-1}(X_n, Y_n).$$

R is the magnitude, t is time, j is the unit imaginary number (a constant, the square root of −1), and e is Euler's number (a constant). At any time, time and acceleration can be decomposed into translational acceleration $A_t$ with angle β and rotational acceleration $A_r$ with rotation angle ω, assuming the offset angle (either with respect to magnetic north if the tool position is more vertical or highside if the tool position is more horizontal) is Φ(t) for the first sensor board in an earth coordinate system. The decomposition of motions to obtain measurements of $A_t$ and $A_r$ for each sensor is represented by the following set of Equations (2):

$$\begin{aligned} A_t(t)e^{j\beta(t)} + A_r(t)e^{j\omega(t)} &= R_1(t)e^{j(\Phi(t)+\theta_1(t))} \\ A_t(t)e^{j\beta(t)} + A_r(t)e^{j(\omega(t)+\alpha_1(t))} &= R_2(t)e^{j(\Phi(t)+\theta_2(t))} \\ &\ldots \\ A_t(t)e^{j\beta(t)} + A_r(t)e^{j(\omega(t)+\alpha_{n-1}(t))} &= R_n(t)e^{j((\Phi(t)+\theta_n(t))} \end{aligned} \tag{Eqs. (2)}$$

The above calculations may be represented by the following matrix representation, Equation (3):

$$\underbrace{\begin{bmatrix} 1 & 1 \\ 1 & e^{j\alpha_1} \\ \ldots & \ldots \\ 1 & e^{j\alpha_{n-1}} \end{bmatrix}}_{[A]} \underbrace{\begin{bmatrix} A_t(t)e^{j\beta(t)} \\ A_t(t)e^{j\omega(t)} \end{bmatrix}}_{[B]} = \underbrace{\begin{bmatrix} R_1(t)e^{j(\Phi(t)+(\theta_1(t))} \\ R_2(t)e^{j(\Phi(t)+\theta_2(t))} \\ \ldots \\ R_n(t)e^{j(\Phi(t)+\theta_n(t))} \end{bmatrix}}_{[C]} \tag{Eq. (3)}$$

$A_t e^{j\beta}$ (translational acceleration) and $A_r e^{j\omega}$ (rotation acceleration) are solved based on the following matrix equation by inverting the [A] matrix defining the relative position of the sensors to each other and the [C] matrix representing the measurements for each of the sensors, represented by Equation (4), wherein $\alpha_1, \ldots \alpha_{n-1}$ are design parameters, and Rn (t), θn(t) and Φ(t) are measured quantities.

$$\begin{bmatrix} A_t(t)e^{j\beta(t)} \\ A_r(t)e^{j\omega(t)} \end{bmatrix} = \begin{bmatrix} 1 & 1 \\ 1 & e^{j\alpha_1} \\ \ldots & \ldots \\ 1 & e^{j\alpha_{n-1}} \end{bmatrix}^{-1} \begin{bmatrix} R_1(t)e^{j(\Phi(t)+(\theta_1)} \\ R_2(t)e^{j(\Phi(t)+\theta_2)} \\ \ldots \\ R_n(t)e^{j(\Phi(t)+\theta_n)} \end{bmatrix} \tag{Eq. (4)}$$

Once the translational acceleration and rotation acceleration is known, the raw data from the sensors may be transformed and interpreted as if the sensors are positioned orthogonal to each other and manipulated to determine motion data of the tool within the wellbore, which may then be used to interpret wellbore properties such as resistivity, porosity, density, and gamma ray levels, magnetic field, vibration, as well as other properties like borehole size and shape. The motion data may be used to understand/explain anomalies and strange behavior in LWD measurements, and to correct LWD data. The motion data may also provide important MWD data to help with drilling parameters.

Figure 4B:
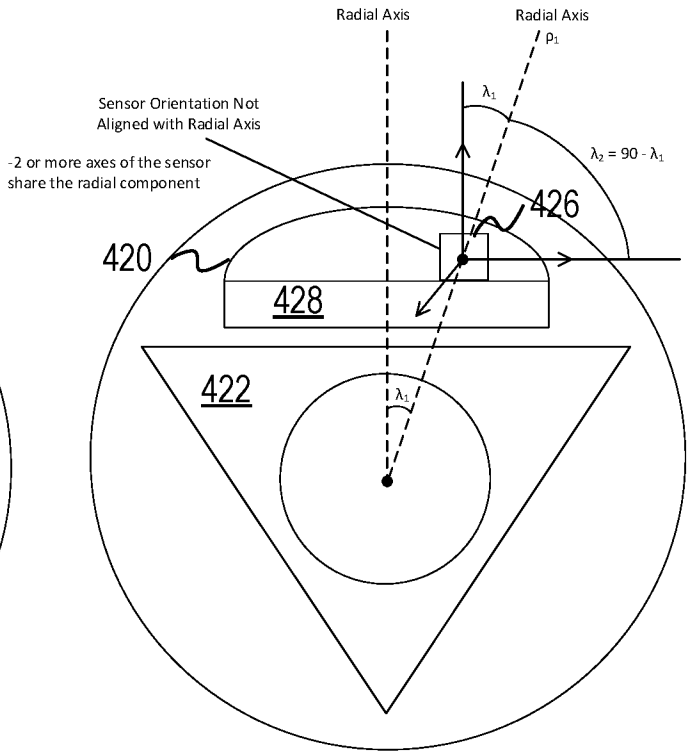
FIG. 4B is an illustration of one example of positional relationships where a sensor component is not aligned with a radial axis of a downhole tool, according to some embodiments.
Figure 4A:
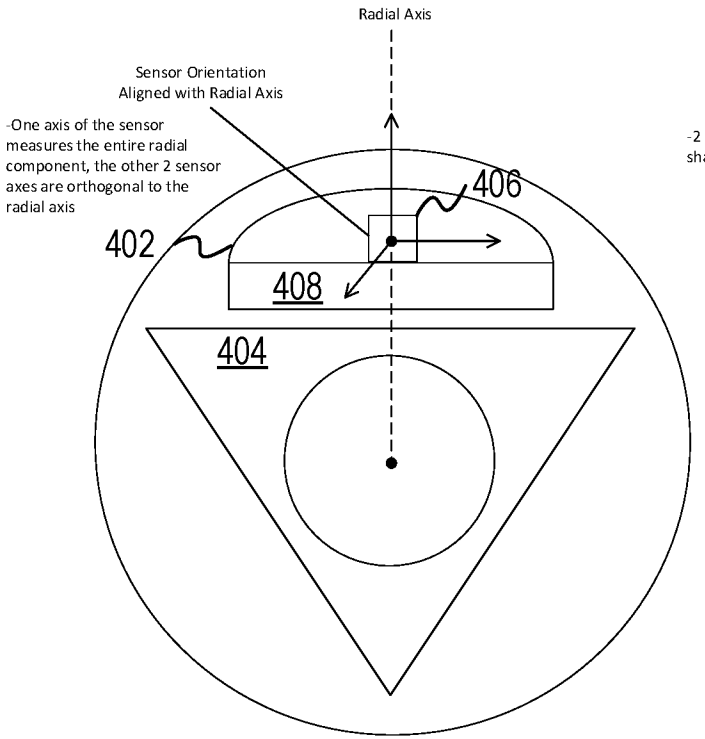
FIG. 4A is an illustration of one example of positional relationships where a sensor component is aligned with a radial axis of a downhole tool, according to some embodiments.

FIGS. 4A and 4B illustrate additional examples of positional relationships for non-collinear sensors (or sensor/PCB assemblies) positioned on a downhole tool electronics chassis. FIG. 4A is an illustration of a positional relationships where a sensor component is aligned with a radial axis of a downhole tool, according to some embodiments. FIG. 4B is an illustration of a positional relationships where a sensor component is not aligned with a radial axis of a downhole tool, according to some embodiments.

Typically, as in the previous embodiments of FIG. 3A-3D, the sensor assembly has a sensor component positioned on the PCB at or near the center of the PCB and it is advantageous and/or simpler to place the sensor assembly in the center of the electronics module of the chassis such that one axis of the sensor is aligned with the radial axis of the downhole tool and measures the entire radial component, while the other 2 sensor axes are orthogonal to the radial axis (no sensitivity). However, due to space constraints on the tool electronics, and design or space constraints of the PCB of a sensor assembly, the sensor component may not be centered on the PCB and sometimes the sensor cannot be placed directly in the center of the electronics module and thus, the sensor orientation is not aligned with the radial axis of the tool. The calculations described above and in reference to the examples of FIG. 3A-3D assume that a single axis of the sensor is aligned with and measures the radial component/axis of the tool. In FIG. 4A, a sensor assembly 402 is shown on a downhole tool electronics chassis 404. The sensor assembly 402 includes a sensor component 406 mounted on a PCB 408 where a single axis of the sensor component 406 is aligned with the radial axis of the tool chassis 404.

In FIG. 4B, a sensor assembly 420 is shown on a downhole tool electronics chassis 422. The sensor assembly 420 includes a sensor component 426 mounted on a PCB 428 where the sensor component 426 is not aligned with the radial axis of the downhole tool electronics chassis. In this example, additional geometry data for the sensor assembly 420 is needed for processing and interpretation of the raw data collected. The additional geometry data includes ρ and angle λ. $\lambda_n$ is known for each sensor component 426 and represents the angle at which the sensor component 426 is rotated or misaligned from the radial axis of the chassis 422, and ρ represents the radial axis of the sensor component 426.

Raw data collected from the sensors not aligned with the radial axis of the downhole tool, and not positioned orthogonal or collinear with respect to other sensors, such as those in FIG. 4B, may be processed according to the following equations to solve for translational acceleration ($A_t$) and rotational acceleration ($A_r$) in order to interpret the raw sensor data as if the sensors are positioned orthogonal and/or collinear.

Suppose there are n sensors with n−1 angles: $\alpha_1$ between $1^{st}$ and $2^{nd}$ sensors, $\alpha_2$ between $1^{st}$ and $3^{rd}$, . . . $\alpha_{n-1}$ between $1^{st}$ and $n^{th}$. Each sensor has X (parallel to board) and Y (perpendicular to board) in the rotation frame with the 1st sensor. The X and Y components of each sensor is represented according to the following Equations (5), expressing each sensor in a complex number based on how each sensor assembly (sensor and PCB) are mounted on the tool:

$$1^{st} \text{ sensor } (X_1, Y_1) = R_1 e^{j\theta_1}, \text{ expressing in complex number} \quad \text{Eqs. (5)}$$
$$2^{nd} \text{ sensor } (X_2, Y_2) = R_2 e^{j\theta_2},$$
$$\ldots$$
$$n^{th} \text{ sensor } (X_n, Y_n) = R_n e^{j\theta_n}$$

wherein $\theta_n$ is the angle measured on $n^{th}$ sensor in its own coordinate system, $$R_n = \sqrt{X_n^2 + Y_n^2},$$

$\theta_n = \tan^{-1}(X_n, Y_n)$, and $\lambda_n$ is the angle of the sensor misalignment (rotation) to the radial axis of the tool as shown in FIG. 4B.

At anytime, t, acceleration can be decomposed into translational $A_t$ with angle $\beta$ and rotational $A_r$ with rotation angle $\omega$, assuming the offset angle (either with respect to magnetic north or highside) is $\Phi(t)$ for $1^{st}$ sensor assembly in an earth coordinate system. The decomposition of motions to obtain measurements of $A_t$ and $A_r$ for each sensor is represented by the following set of Equations (6):

$$A_t(t)e^{j\beta(t)} + \rho_1 A_r(t)e^{j\omega(t)+\lambda_1} = R_1(t)e^{j(\Phi(t)+\theta_1(t))} \quad \text{Eq. (6)}$$
$$A_t(t)e^{j\beta(t)} + \rho_2 A_r(t)e^{j(\omega(t)+\alpha_1+\lambda_1)} = R_2(t)e^{j(\Phi(t)+\theta_2(t))}$$
$$\ldots$$
$$A_t(t)e^{j\beta(t)} + \rho_n A_r(t)e^{j(\omega(t)+\alpha_{n-1}+\lambda_1)} = R_n(t)e^{j((\Phi(t)+\theta_n(t))}$$

$A_t e^{j\beta}$ (translational acceleration) and $A_r e^{j\omega}$ (rotation acceleration) are solved based on above equations and put into the following matrix representation, Equation (7):

$$\begin{bmatrix} 1 & \rho_2 e^{j\lambda_1} \\ 1 & \rho_2 e^{j(\alpha_1+\lambda_1)} \\ \ldots & \ldots \\ 1 & \rho_n e^{j(\alpha_{n-1}+\lambda_1)} \end{bmatrix} \begin{bmatrix} A_t(t)e^{j\beta(t)} \\ A_r(t)e^{j\omega(t)} \end{bmatrix} = \begin{bmatrix} R_1(t)e^{j(\Phi(t)+(\theta_1(t))} \\ R_2(t)e^{j(\Phi(t)+\theta_2(t))} \\ \ldots \\ R_n(t)e^{j(\Phi(t)+\theta_n(t))} \end{bmatrix} \quad \text{Eq. (7)}$$

$A_t$ and $A_r$ are then solved for by inverting the [A] matrix defining the relative position of the sensors to each other and the [C] matrix representing the measurements for each of the sensors according to the following Equation (8), wherein $\alpha_1, \ldots \alpha_{n-1}$ are design parameters, and Rn (t), θn(t) and $\Phi(t)$ are measured quantities.

$$\begin{bmatrix} A_t(t)e^{j\beta(t)} \\ A_r(t)e^{j\omega(t)} \end{bmatrix} = \begin{bmatrix} 1 & \rho_2 e^{j\lambda_1} \\ 1 & \rho_2 e^{j(\alpha_1+\lambda_1)} \\ \ldots & \ldots \\ 1 & \rho_n e^{j(\alpha_{n-1}+\lambda_1)} \end{bmatrix}^{-1} \begin{bmatrix} R_1(t)e^{j(\Phi(t)+(\theta_1)} \\ R_2(t)e^{j(\Phi(t)+\theta_2)} \\ \ldots \\ R_n(t)e^{j(\Phi(t)+\theta_n)} \end{bmatrix} \quad \text{Eq. (8)}$$

The transformed data is then used to determine motion data of the downhole tool, which may include vibration, magnetic field, or acceleration of the downhole tool, for example. The downhole tool may need to be adjusted or an operation may need adjusted or performed based on the motion data. The motion data may then be used and interpreted as traditional LWD or MWD data is, for example, to determine at least one property in the wellbore, which may include, for example, formation properties such as resistivity, porosity, density, and gamma ray levels, as well as other properties like borehole size and shape. The motion data may be used to understand/explain anomalies and strange behavior in LWD measurements, and to correct LWD data. The motion data may also provide important MWD data to help with drilling parameters.

Although the above descriptions in FIGS. 3A-3D and 4A-4B are described and applied to two-dimensional motion, the equations may be expanded to solve for axial motion along the Z axis ($A_z$) to determine three-dimensional motion experienced by the sensors.

At a block 518, the motion data is then used and interpreted as traditional LWD or MWD data is, for example, to determine at least one property in the wellbore, which may include, for example, formation properties such as resistivity, porosity, density, and gamma ray levels, as well as other properties like borehole size and shape.

Example Operations

Figure 5:
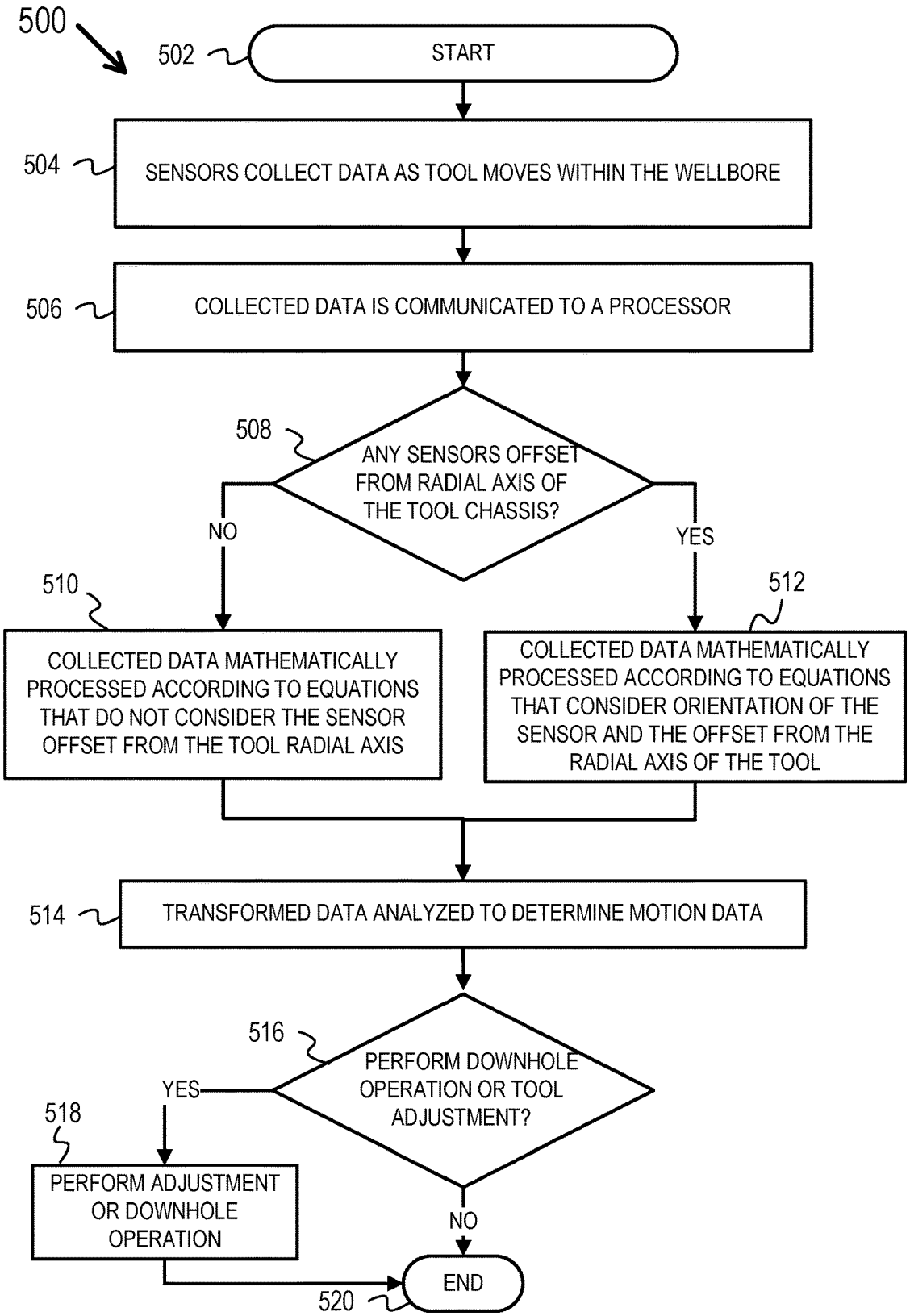
FIG. 5 is a flowchart illustrating example operations for data processing correction of raw data collected from sensors positioned non-collinear and non-orthogonal relative to each other, according to some embodiments.

The data from the sensors is now transformed. FIG. 5 is a flowchart illustrating one embodiment of a method for mathematically transforming raw data collected from non-orthogonal and non-collinear sensors into transformed data that represents orthogonal placement of the sensors. The operations are described with reference to the systems of FIGS. 1-4. However, the operations can be performed by other systems or components. For example, at least some of the operations of the flowchart 500 are described as being performed by a computer at a surface of the wellbore. In some embodiments, one or more of these operations can be performed by a computer at the surface and/or downhole in the wellbore. The operations of the flowchart 500 start at block 502.

At block 504, sensors, such as sensor components and PCBs mounted non-collinear and/or non-orthogonal on a downhole tool, such as sensors shown in FIGS. 3C, 3D and 4B, collect data as a tool, such as logging tool 102, moves downhole in a wellbore. In block 506, the collected raw data is communicated to a processor. Prior to drilling operations, certain geometries and placement data inputs for the sensors may be provided to the processor, such as the number of sensors, n; unit imaginary number, j; Euler's number/constant, e; angles measured at each sensor based on their placement, including $\Theta_n$; the angle relative to magnetic north or highside, determined downhole, $\Phi_n$; and the angles between the sensors, $\alpha$. If the sensor component is not aligned with the radial axis of the tool chassis, such as in FIG. 4B, the axis $\rho$ and the angle $\lambda$ and are also known.

At block 508, the method determines whether any of the sensors are offset from the radial axis of the tool chassis, or if the. If none of the sensors are offset with the radial axis of the tool chassis, the method continues to step 510 where the received raw data is mathematically processed according to the equations 1-4 presented herein, to transform the data into transformed data representing data as if collected from orthogonally placed sensors These equations 1-4 do not consider the radial axis alignment of the sensors to the tool chassis. If any of the sensors are radially offset and not aligned with the radial axis of the tool chassis, then the method continues to step 512 wherein the raw data is mathematically processed according to equations 5-8 presented herein that consider the orientation of the sensor and the offset from the radial axis of the tool chassis, to transform the data into transformed data representing data as if collected from radially aligned sensor components on orthogonally placed sensors.

At block 514, the transformed data is analyzed to determine motion data within the wellbore. The motion data may include one or more of vibration of the tool, magnetic field within the wellbore, lateral or axial displacement, rotation, and acceleration of the downhole tool.

At block 516, the method continues with determining whether or not a downhole tool operation or adjustment may be needed based on the motion data. If yes, an adjustment or operation is made at block 518 and the method ends at block 520.

In addition to determining one or more properties in the wellbore, the transformed data, including $A_r$ and $A_t$, may be used to correct or interpret data collected from other tools or sensors in the wellbore that may be sensitive to motion, such as NMR sensors, imaging tools and sensors, and acoustic tools and sensors.

The flowchart is provided to aid in understanding the illustrations and are not to be used to limit scope of the claims. The flowchart depicts example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a computer or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, optical fiber cable, RF, etc., or any suitable combination of the foregoing.

The program code/instructions may also be stored in a non-transitory machine-readable medium that can direct a machine or processor to function in a particular manner, such that the instructions stored in the machine-readable medium produce an article of manufacture including instructions which implement the function/act specified in the flowchart and/or block diagram block or blocks.

Example Computer

Figure 6:
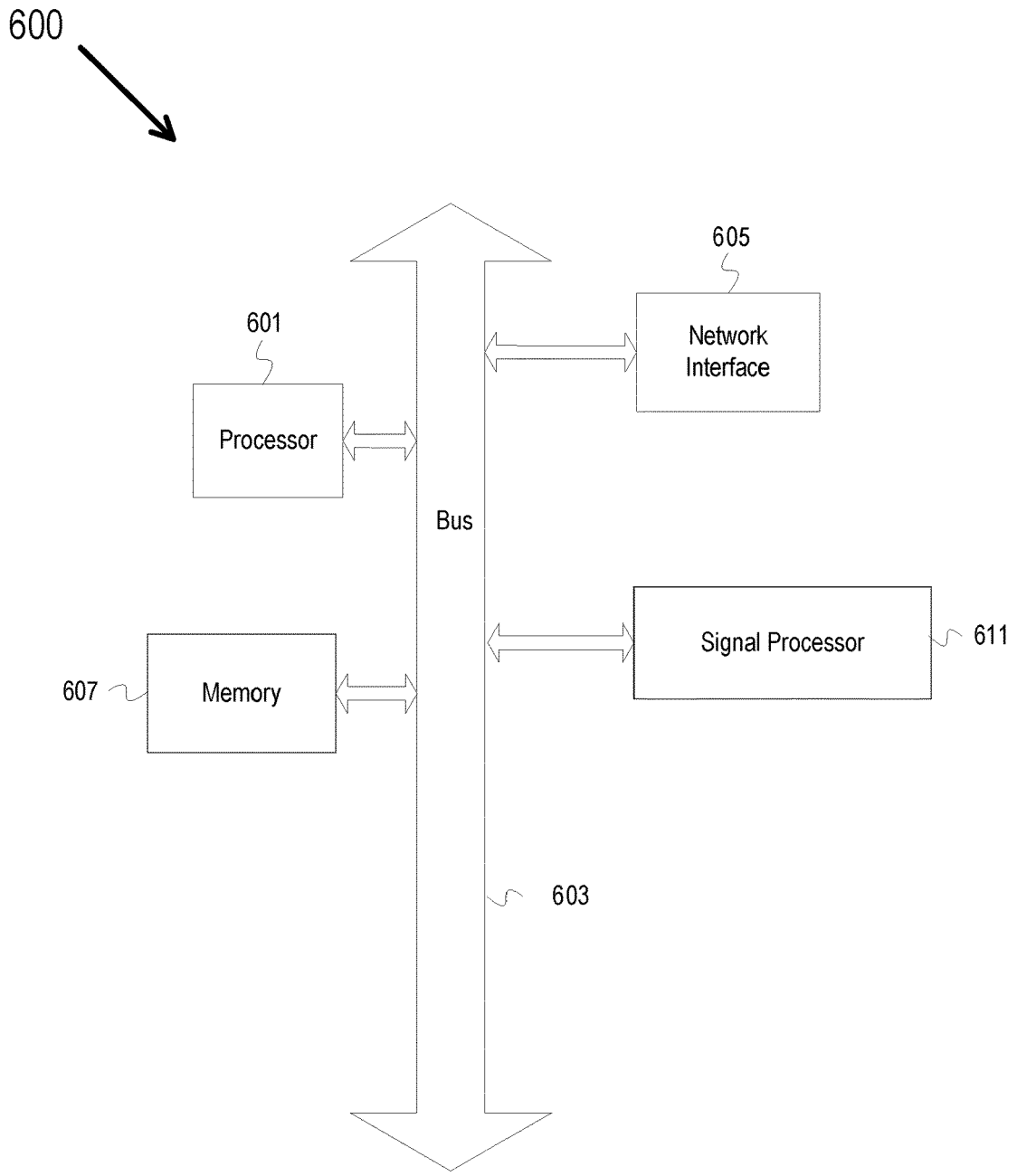
FIG. 6 a block diagram of an example computer, according to some embodiments.

FIG. 6 depicts an example computer, according to some embodiments. A computer 600 includes a processor 601 (possibly including multiple processors, multiple cores, multiple nodes, and/or implementing multi-threading, etc.). The computer 600 includes a memory 607. The memory 607 may be system memory or any one or more of the above already described possible realizations of machine-readable media. The computer 600 also includes a bus 603 and a network interface 606. The computer 600 can communicate via transmissions to and/or from remote devices, such as sensors mounted on the downhole tool as shown in FIGS. 3C and 3D, for example, via the network interface 605 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 600 also includes a signal processor 611 that can perform at least some of the operations described herein. Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and examples, it will be understood that these aspects are illustrative and that the scope of the claims is not limited to them.

No implementations of the methods or data transformation described herein include any operations that may be performed in the human mind, done with pencil and paper, or otherwise performed without tangible machinery. Furthermore, the claims exclude all implementations that include operations performed in the human mind, operations performed with pencil and paper, and operations performed without tangible machinery.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Aspects disclosed herein include:

Aspect A: A method comprising: receiving data from a first sensor mounted on a chassis of a downhole tool; receiving data from a second sensor, wherein the second sensor is mounted on the chassis and is positioned non-collinear relative to the first sensor; mathematically transforming the received data from the first and second sensor such that the transformed data represents the first sensor and the second sensor as if positioned orthogonal relative to each other; and determining motion data in a wellbore from the transformed data.

Aspect B: A system, comprising a downhole tool for use in a wellbore; at least a first sensor and a second sensor mounted on a chassis of the downhole tool, wherein the first sensor and second sensor are non-orthogonal and non-collinear relative to each other; and a processor; the processor configured to: receive data from the first sensor; receive data from the second sensor; mathematically transform the received data from the first sensor and the second sensor such that the transformed data represents the first sensor and the second sensor as if positioned orthogonal relative to each other; and determine motion data in the wellbore from the transformed data.

Aspect C: An apparatus comprising a processor; and a non-transitory computer-readable medium having instructions stored thereon that are executable by the processor to cause the processor to: receive data from at least a first sensor and a second sensor mounted on a downhole tool, wherein the first sensor and second sensor are positioned non-orthogonal and non-collinear relative to each other, wherein the data is collected as the downhole tool is moving within a wellbore; mathematically transform the received data from the first sensor and the second sensor such that the transformed data represents the first sensor and the second sensor as if positioned orthogonal relative to each other; and determine motion data in the wellbore from the transformed data.

Aspects A, B, and C may have one or more of the following additional elements in combination:

Element 1: further comprising determining that at least one of the first and second sensors are not aligned with a radial axis of the chassis and mathematically transforming the received data according to equations that consider an angle that each of the first and second sensor is offset from the radial axis of the chassis.

Element 2: further comprising: receiving data from a third sensor mounted on the downhole tool, wherein the third sensor is non-collinear relative to the first sensor and the second sensor; and mathematically transforming the received data from the first sensor, the second sensor, and the third sensor such that the transformed data represents the first sensor, second sensor, and third sensor as if positioned orthogonal or colinear relative to each other.

Element 3: wherein transforming the received data includes determining translational motion of the downhole tool.

Element 4: wherein transforming the received data includes determining rotational motion of the downhole tool.

Element 5: wherein the motion data is one of vibration of the downhole tool, magnetic field within the wellbore, lateral or axial displacement, rotation, and acceleration of the downhole tool.

Element 6: wherein the first and second sensors are one of logging while drilling (LWD) sensors and measurement while drilling (MWD) sensors.

Element 7: further comprising receiving data from additional sensors positioned downhole and correcting or interpreting the received data from additional sensors based on the mathematically transformed data.

Element 8: wherein the additional sensors are configured to collect acoustic data, nuclear magnetic resonance (NMR) data, and imaging data.

Element 9: further comprising directing operation or one or more downhole tools according to the motion data.

Element 10: a third sensor mounted on the chassis, wherein the third sensor is non-collinear and non-orthogonal relative to the first sensor and the second sensor; and wherein the processor is further configured to: receive data from the third sensor; and mathematically transform the received data from the first sensor, second sensor, and the third sensor such that the transformed data represents the first sensor, second sensor, and third sensor as if positioned orthogonal or colinear relative to each other.

The invention claimed is:

1. A method comprising:

receiving data from n sensors mounted on a logging tool positioned on a chassis of a downhole tool, where n is an integer greater than 2, wherein the n sensors include a first sensor and a second sensor, wherein the second sensor is positioned non-orthogonal and non-collinear relative to the first sensor; and determining motion data in a wellbore from the received sensor data, wherein determining the motion data includes determining acceleration at a time t as a translational acceleration $A_t e^{j\beta}$ at an angle β and a rotational acceleration $A_r e^{j\omega}$ with a rotation angle ω, wherein $$\begin{bmatrix} A_t(t)e^{j\beta(t)} \\ A_r(t)e^{j\omega(t)} \end{bmatrix} = \begin{bmatrix} 1 & 1 \\ 1 & e^{j\alpha_1} \\ \dots & \dots \\ 1 & e^{j\alpha_{n-1}} \end{bmatrix}^{-1} \begin{bmatrix} R_1(t)e^{j(\Phi(t)+(\theta_1)} \\ R_2(t)e^{j(\Phi(t)+(\theta_2)} \\ \dots \\ R_n(t)e^{j(\Phi(t)+(\theta_n)} \end{bmatrix}$$

where $\alpha_1, \ldots \alpha_{n-1}$ are design parameters and $R_n(t)$, $\theta_n$ and $\Phi(t)$ are measured quantities.

2. The method according to claim 1, wherein at least one of the first and second sensors are not aligned with a radial axis of the chassis.

3. The method according to claim 1, wherein the $n^{th}$ sensor is non-collinear relative to the first sensor and the second sensor.

4. The method according to claim 1, wherein determining motion data includes determining translational motion of the downhole tool.

5. The method according to claim 1, wherein determining motion data includes determining rotational motion of the downhole tool.

6. The method according to claim 1, wherein the motion data further includes one or more of vibration of the downhole tool, magnetic field within the wellbore, lateral or axial displacement, rotation, and acceleration of the downhole tool.

7. The method according to claim 1, wherein the first and second sensors are one of logging while drilling (LWD) sensors and measurement while drilling (MWD) sensors.

8. The method according to claim 1, further comprising:

receiving data from additional sensors m and p, where m and p are less than n; and determining the translational acceleration $A_t e^{j\beta}$ and the rotational acceleration $A_r e^{j\omega}$ as a function of $R_m(t)e^{j(\Phi(t)+\theta_m)}$ and $R_p(t)e^{j(\Phi(t)+\theta_p)}$.

9. The method according to claim 1, further comprising receiving data from additional sensors wherein the additional sensors are configured to collect acoustic data, nuclear magnetic resonance (NMR) data, and imaging data.

10. The method according to claim 1, further comprising directing operation or one or more downhole tools according to the motion data.

11. A system, comprising:

a downhole tool for use in a wellbore;

at least n sensors, where n is an integer greater than 2, each sensor mounted on a logging tool positioned on a chassis of the downhole tool, wherein the n sensors include a first sensor and a second sensor, wherein the first sensor and second sensors are non-orthogonal and non-collinear relative to each other; and a processor; the processor configured to:

receive data from the n sensors; and determine motion data in the wellbore from the received sensor data, wherein determining the motion data includes determining acceleration at a time t as a translational acceleration $A_t e^{j\beta}$ at an angle $\beta$ and a rotational acceleration $A_r e^{j\omega}$ with a rotation angle $\omega$, wherein $$\begin{bmatrix} A_t(t)e^{j\beta(t)} \\ A_r(t)e^{j\omega(t)} \end{bmatrix} = \begin{bmatrix} 1 & 1 \\ 1 & e^{j\alpha_1} \\ \ldots & \ldots \\ 1 & e^{j\alpha_{n-1}} \end{bmatrix}^{-1} \begin{bmatrix} R_1(t)e^{j(\Phi(t)+(\theta_1)} \\ R_2(t)e^{j(\Phi(t)+(\theta_2)} \\ \ldots \\ R_n(t)e^{j(\Phi(t)+(\theta_n)} \end{bmatrix}$$

where $\alpha_1, \ldots \alpha_{n-1}$ are design parameters and $R_n(t)$, $\theta_n$ and $\Phi(t)$ are measured quantities.

12. The system according to claim 11, wherein at least one of the first and second sensors are not aligned with a radial axis of the chassis.

13. The system according to claim 11, wherein the $n^{th}$ sensor is non-collinear and non-orthogonal relative to the first sensor and the second sensor.

14. The system according to claim 11, wherein the processor configured to determine motion data from the received data includes memory having instructions which, when executed by the process, determines translational motion and rotational motion of the downhole tool.

15. The system according to claim 11, wherein the motion data further includes one or more of vibration of the downhole tool, magnetic field within the wellbore, lateral or axial displacement, rotation, and acceleration of the downhole tool.

16. An apparatus comprising:

a processor; and a non-transitory computer-readable medium having instructions stored thereon that are executable by the processor to cause the processor to:

receive data from n sensors, where n is an integer greater than 2, each sensor mounted on a logging tool positioned on a chassis of a downhole tool, wherein the n sensors include a first sensor and a second sensor, wherein the first sensor and the second sensor are positioned non-orthogonal and non-collinear relative to each other, wherein the data is collected as the downhole tool is moving within a wellbore; and determine motion data in the wellbore from the received sensor data, wherein determining the motion data includes determining acceleration at a time t as a translational acceleration $A_t e^{j\beta}$ at an angle $\beta$ and a rotational acceleration $A_r e^{j\omega}$ with a rotation angle $\omega$, wherein $$\begin{bmatrix} A_t(t)e^{j\beta(t)} \\ A_r(t)e^{j\omega(t)} \end{bmatrix} = \begin{bmatrix} 1 & 1 \\ 1 & e^{j\alpha_1} \\ \ldots & \ldots \\ 1 & e^{j\alpha_{n-1}} \end{bmatrix}^{-1} \begin{bmatrix} R_1(t)e^{j(\Phi(t)+(\theta_1)} \\ R_2(t)e^{j(\Phi(t)+(\theta_2)} \\ \ldots \\ R_n(t)e^{j(\Phi(t)+(\theta_n)} \end{bmatrix}$$

where $\alpha_1, \ldots \alpha_{n-1}$ are design parameters and $R_n(t)$, $\theta_n$ and $\Phi(t)$ are measured quantities.

17. The apparatus according to claim 16, wherein at least one of the first and second sensors are not aligned with a radial axis of the chassis.

18. The apparatus according to claim 16, wherein the $n^{th}$ sensor is non-collinear and non-orthogonal relative to the first sensor and the second sensor.

19. The apparatus according to claim 16, wherein the instructions that, when executed by the processor, determine motion data in the wellbore from the received data include instructions that, when executed by the processor, determine translational motion of the downhole tool and determine rotational motion of the downhole tool, wherein the motion data further includes one or more of vibration of the downhole tool, magnetic field within the wellbore, lateral or axial motion, rotation, and acceleration of the downhole tool.

* * * * *